US006400264B1

(12) United States Patent
Hsieh

(10) Patent No.: US 6,400,264 B1
(45) Date of Patent: Jun. 4, 2002

(54) COMMUNITY FAR END INTELLIGENT IMAGE MONITOR

(76) Inventor: Chi-Sheng Hsieh, 7F-6, No. 35, Shintai Rd., Jubei City, Hsin Chu Hsien (TW)

( * ) Notice: Subject to any disclaimer, the term of this patent is extended or adjusted under 35 U.S.C. 154(b) by 0 days.

(21) Appl. No.: 09/714,171

(22) Filed: Nov. 17, 2000

(51) Int. Cl.[7] ..... G08B 29/00

(52) U.S. Cl. ..... 340/506; 340/524; 340/541

(58) Field of Search ..... 340/540, 541, 340/545.2, 545.3, 506, 520, 524, 525, 539; 348/155, 169, 143, 152, 153, 157, 14.05, 14.01, 14.06; 345/835, 863

(56) References Cited

U.S. PATENT DOCUMENTS 4,081,830 A * 3/1978 Mick et al. ..... 348/155
4,857,912 A * 8/1989 Everett, Jr. et al. ..... 340/541
5,144,661 A * 9/1992 Shamosh et al. ..... 340/540
5,412,708 A * 5/1995 Katz ..... 348/14.05
5,550,754 A * 8/1996 McNelley et al. ..... 348/14.01
5,598,208 A * 1/1997 McClintock ..... 348/159
5,652,849 A * 7/1997 Conway et al. ..... 345/719
6,195,122 B1 * 2/2001 Vincent ..... 348/169
6,271,752 B1 * 8/2001 Vaios ..... 340/541

* cited by examiner

*Primary Examiner*—Van T Trieu
(74) *Attorney, Agent, or Firm*—Rosenberg, Klein & Lee

(57) ABSTRACT

A community far end intelligent image monitoring system for remotely monitoring a predetermined local site is provided. The system includes an image recording unit disposed at the local site, at least one portable image monitor unit disposed at a first site remote from the local site, and a programmable safety patrol box unit disposed at a second site remote from both the local and first sites for automatically controlling actuation of the image recording unit. The image recording unit includes at least one camera for capturing a plurality of images at the local site and a programmable servo controller coupled thereto. The portable image monitor unit includes a user interface portion, and is operable to generate responsive to user input a plurality of system control signals including an authorization signal and a camera control signal. The safety patrol box unit is operably coupled to the image recording and portable image monitor units by either a wired or wireless communications link. The safety patrol box unit serves to selectively relay the images captured by the image recording unit responsive to its processing of the system control signals generated by the portable image monitor unit.

20 Claims, 5 Drawing Sheets

COMMUNITY FAR END INTELLIGENT IMAGE MONITOR

FIELD OF THE INVENTION

The present invention relates to a community far end intelligent image monitoring device having the functions of memory, positioning, automatically tracking, wherein the community far end intelligent image monitoring device has a safety patrol box. The image is transferred by a wired, an authorized code, or a wireless way. Further, the community far end intelligent image monitoring device has a portable image monitor for controlling an indoor camera.

BACKGROUND OF THE INVENTION

In general, a community is employed with safeguards for patrolling or by the residents to patrol the community. Some doors are installed with reed switches. When the undesired peoples intrude from the door, an alarm is emitted. However, such way is impractical in current days since the power can be interrupted manually. Moreover, the residents are possibly held as hostages. As rescuers have arrived at the place, it can not really know the indoor conditions. Furthermore, there is no reasonable reason for the rescuers to enter into the resident's home for rescuing the hostage since they can not assure the peoples are held so that the first timing for rescuing is lost. Currently, a network far end monitoring way is developed, however, the network is not popular. Furthermore, the computer in home must be opened at any time for using. A certain difficult is existed. Even the aforesaid problems are resolved, many cameras are necessary for monitoring a wide range since the camera is fixed indoors and no functions of memory, positioning, automatically tracking.

SUMMARY OF THE INVENTION

Accordingly, the primary object of the present invention is to provide a community far end intelligent image monitoring device having the functions of memory, positioning, automatically tracking.

Another object of the present invention is to provide a community far end intelligent image monitoring device having a safety patrol box. The image is transferred by a wired, an authorized code, or a wireless way. Further, the community far end intelligent image monitoring device has a portable image monitor for controlling an indoor camera.

In order to achieve the aforesaid object, the present invention provides a community far end intelligent image monitoring device comprising the following components.

An indoor camera has a servo controller for carrying a camera and an image output. The servo controller uses a microchip to control the camera to memory, position, and automatic track. The image output serves to be connected to a resident safety patrol box. The servo controller is installed to an indoor or an outdoor camera. The first image output can be installed in a camera or to a safety patrol box.

The safety patrol box is a relay for transferring the image from an indoor or an outdoor camera. The safety patrol box is installed with an image transmitter for transferring image from the indoor camera through the safety patrol box by a wired or wireless way, further, is installed with an admittance circuit image output. When a correct authorized code is received, the image transmitter in the safety patrol box is actuated for transmitting the image captured by the resident camera and the camera in the safety patrol box is actuated to output a control signal for controlling the automatic tracking, memory, and tracking of the indoor camera. The safety patrol box is further installed with a sensor to sense a destroy. When the solution is destroyed, an alarming device is actuated to emit an alarm and light up an indicator. In normal, the indicator emits green light, while in emergency, the indicator lights up with a flash red light.

A portable image monitor includes an image display, an authorized code output and a camera rotation switch, such as a button or a joystick or a control box. The authorized code output may be a keyboard or a card reader. The camera rotation switch is, for example, a button or a joystick, etc. The communication between the portable image monitor and the safety patrol box may be performed through wired or wireless ways, or through Internet for achieving the object of monitoring. The communication between the portable image monitor and the safety patrol box is based on the safety patrol box receiving the authorized code from the portable image monitor. In the lawful admittance, more than one portable image monitor can communicate with the safety patrol box.

In the community far end intelligent image monitoring device, the photograph monitoring means serves to position and track so that the received image indoors is transferred to the resident safety patrol box through the receiving and transmitting module, and thus the outdoor safeguard can monitor the condition by a wired or wireless way.

The various objects and advantages of the present invention will be more readily understood from the following detailed description when read in conjunction with the appended drawing.

DETAILED DESCRIPTION OF THE PREFERRED EMBODIMENTS

Figure 1:
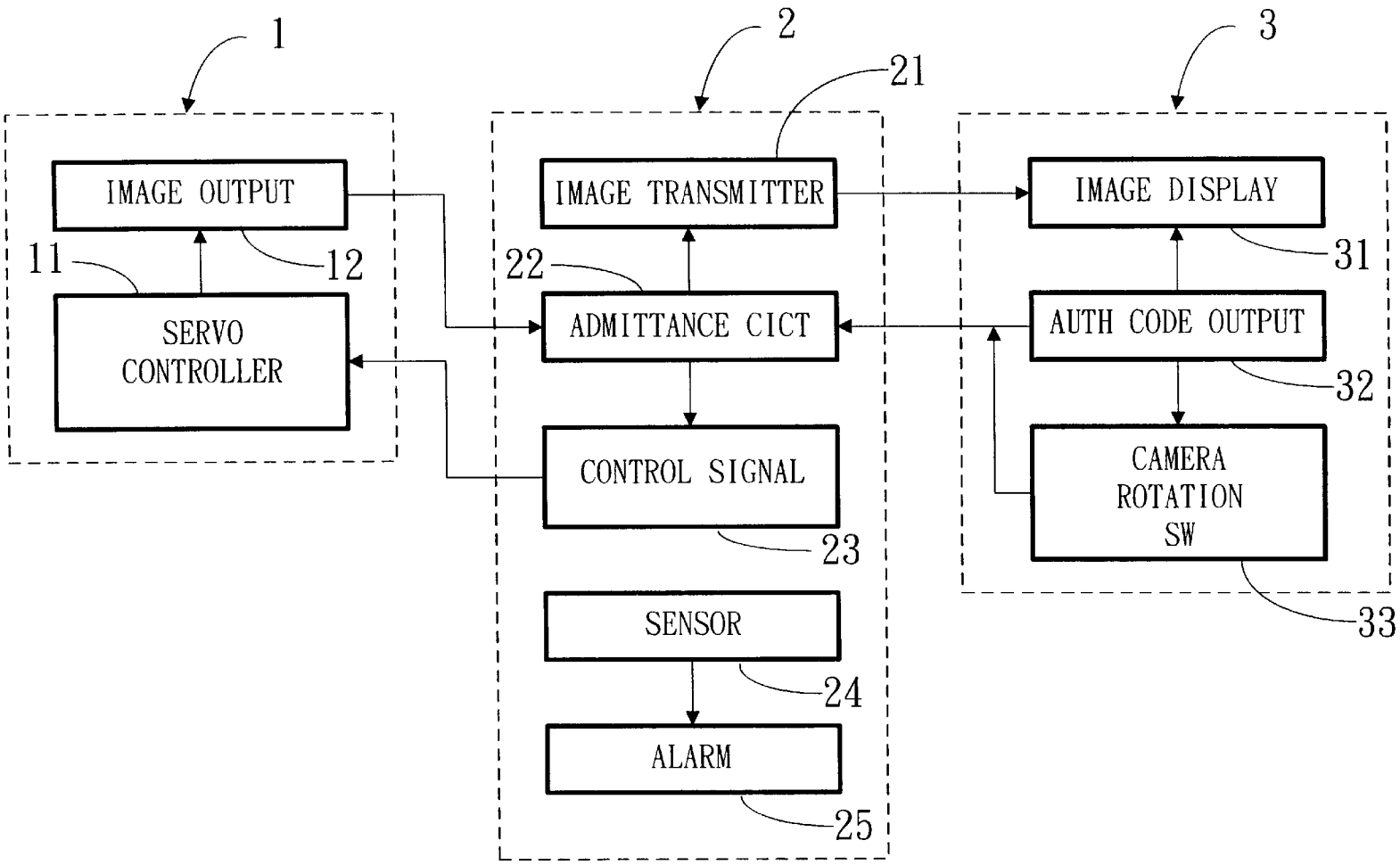
FIG. 1 is a systematic block diagram of the community far end intelligent image monitor according to the present invention.

With reference to FIG. 1, the community far end intelligent image monitoring device of the present invention is illustrated. The community far end intelligent image monitoring device comprises the following components.

An indoor camera 1 has a servo controller 11 for carrying a camera and an image output 12. The servo controller 11 uses a microchip to control the camera to memory, position, and automatic track. The image output 12 serves to be connected to a resident safety patrol box 2. The servo controller 11 is installed to an indoor or an outdoor camera. The first image output 12 can be installed in a camera or to a safety patrol box 2.

The safety patrol box 2 is a relay for transferring the image from an indoor or an outdoor camera. The safety patrol box 2 is installed with an image transmitter 21 for transferring image from the indoor camera through the safety patrol box 2 by a wired or wireless way, further, is installed with an admittance circuit 22 for image output. When a correct authorized code is received, the image transmitter 21 in the safety patrol box is actuated for transmitting the image captured by the resident camera and the camera in the safety patrol box is actuated to output a control signal 23 for controlling the automatic tracking, memory, and tracking of the indoor camera. The safety patrol box 2 is further installed with a sensor 24 to sense a destroy. When the solution is destroyed, an alarming device 25 is actuated to emit an alarm and light up an indicator. In normal, the indicator emits green light, while in emergency, the indicator lights up with a flash red light.

A portable image monitor 3 includes an image display 31, an authorized code output 32 and a camera rotation switch 33, such as a button or a joystick or a control box. The authorized code output 32 may be a keyboard or a card reader. The camera rotation switch 33 is, for example, a button or a joystick, etc. The communication between the portable image monitor 3 and the safety patrol box 2 may be performed through wired 4 or wireless 5 ways, or through Internet 6 for achieving the object of monitoring. The communication between the portable image monitor 3 and the safety patrol box 3 is based on the safety patrol box receiving the authorized code from the portable image monitor 3. In the lawful admittance, more than one portable image monitor 3 can communicate with the safety patrol box 2.

Figure 2:
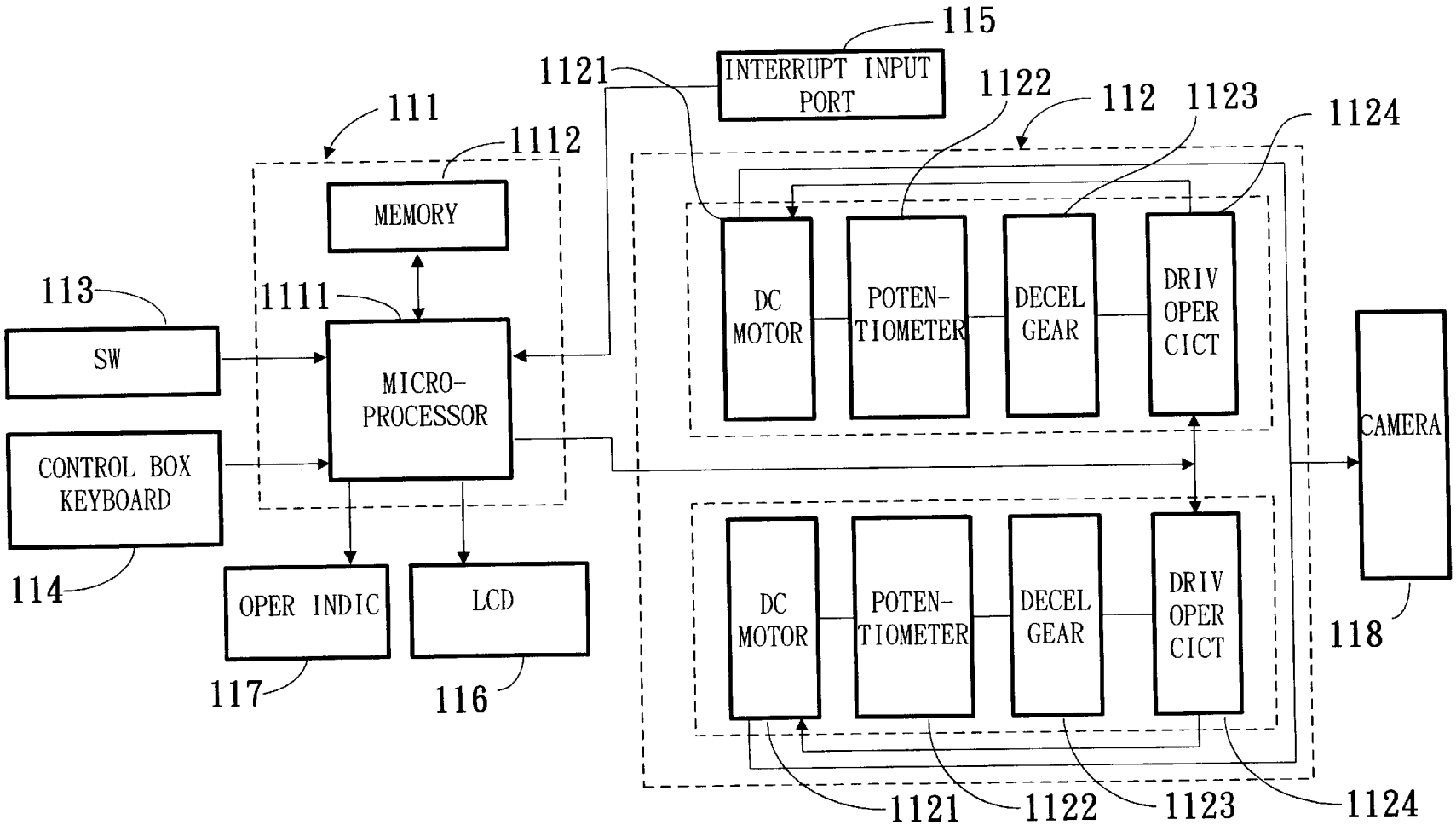
FIG. 2 is a systematic block diagram of the controller of the servo in the present invention for carrying a camera.

Referring to FIG. 2, a control box is installed with a control circuit 111. The control circuit 111 has a microprocessor 1111 and a memory 1112. The memory 1112 stores the controlling data including at least the multiple positioning data preset by the motor of the servo. This data can be modified by the input of the operation keyboard 114 out of the control box and then the result is stored in the memory 1112. By the operation keyboard 114 to input control data, the motor of the servo scans between a first preset initial point and a distal point N. The scanning speed may be changed according to the input data. It has a timing auto tracking function for setting and modulating the tracking speed. Therefore, when the servo motor tracks in a low speed, since the tracking speeds in the horizontal and vertical directions, when the motor tracks from Nth memory position to N+1th memory position, a nonlinear scanning track is formed in two dimensional space. Out of the box has a switch 113, an operation indicator 117, at least one interrupting input port for receiving interrupting signals 115 for being interrupted due to emergency, which generates digital input for various sensors or switches, at least one servo 112 is connected to a servo connecting port, an operation system 114 out the box for inputting data and control instruction for controlling the rotation directions of the servo motors of the servo 112. The coordinate in the travelling of the rotation can be used to position and memory. Other than the functions of slow scanning of the servo 112 for setting and input various data. A liquid crystal display 116 serves for displaying the instructions and data from an operator. A servo 112 is connected to the control box through the servo port; the servo includes at least two servo motor; one is responsible for the carry of the camera 118 so that one camera moves horizontally, and the other moves vertically so as to widen the viewing field. The servo motor contains a D. C. motor 1121, an potentiometer 1122, a deceleration gear 1123 and a driving operating circuit 1124. A camera 118 is installed on the servo. The camera has a plate-like shape or has a telescopic lens. An operable software program is installed. The operating keyboard 114 serves to input control instruction or data. Then the data is processed, operated and stored by a control circuit, and then, a control signal is outputted to drive the servo motor in the servo to operation so that the camera 118 may capture images from various aspects and has the functions of low speed scanning, presetting memory, low speed track scanning, and other functions.

Figure 2A:
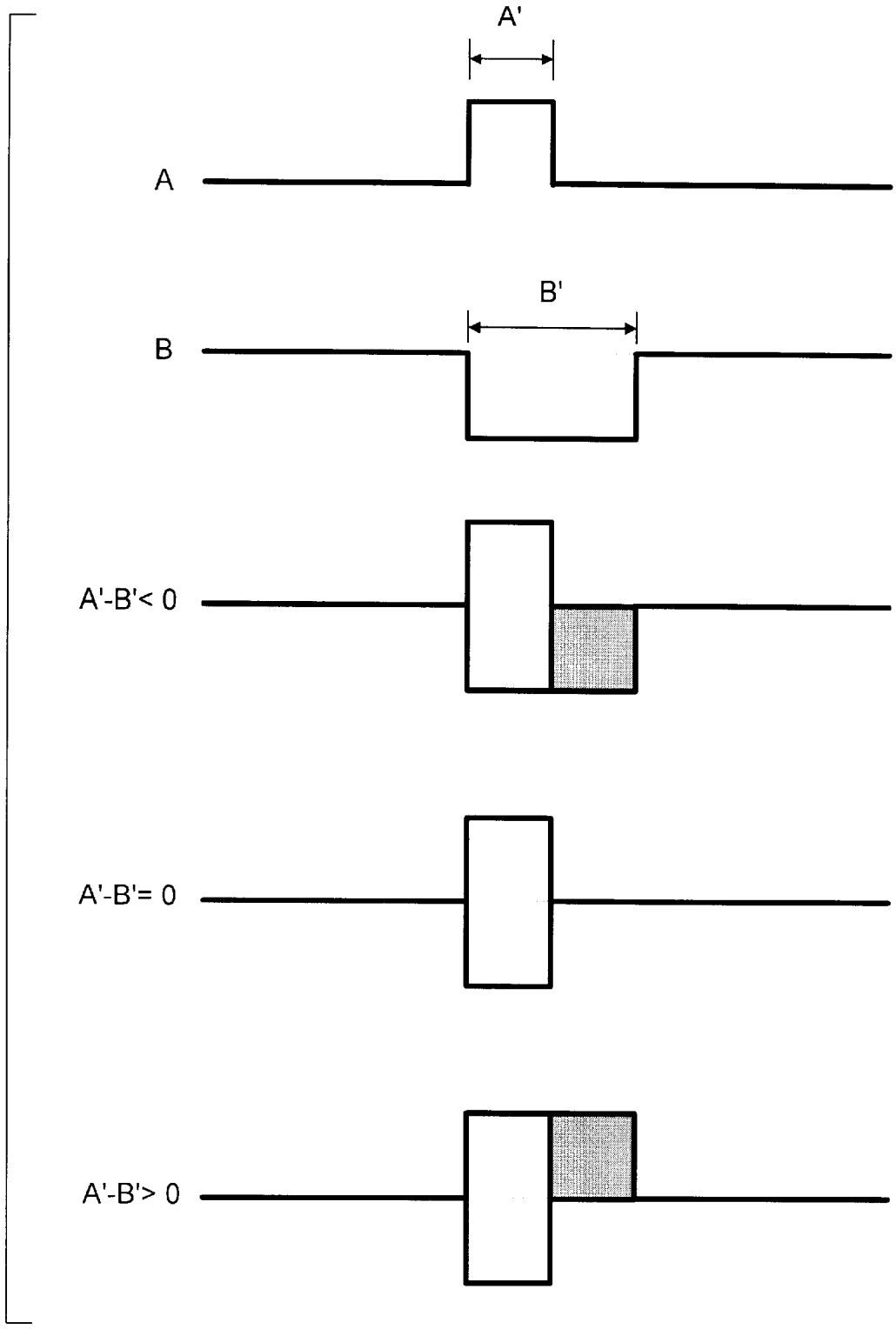
FIG. 2A shows a mathematical diagram of the controller of the servo in the present invention for carrying a community far end intelligent image monitor.
Figure 2B:
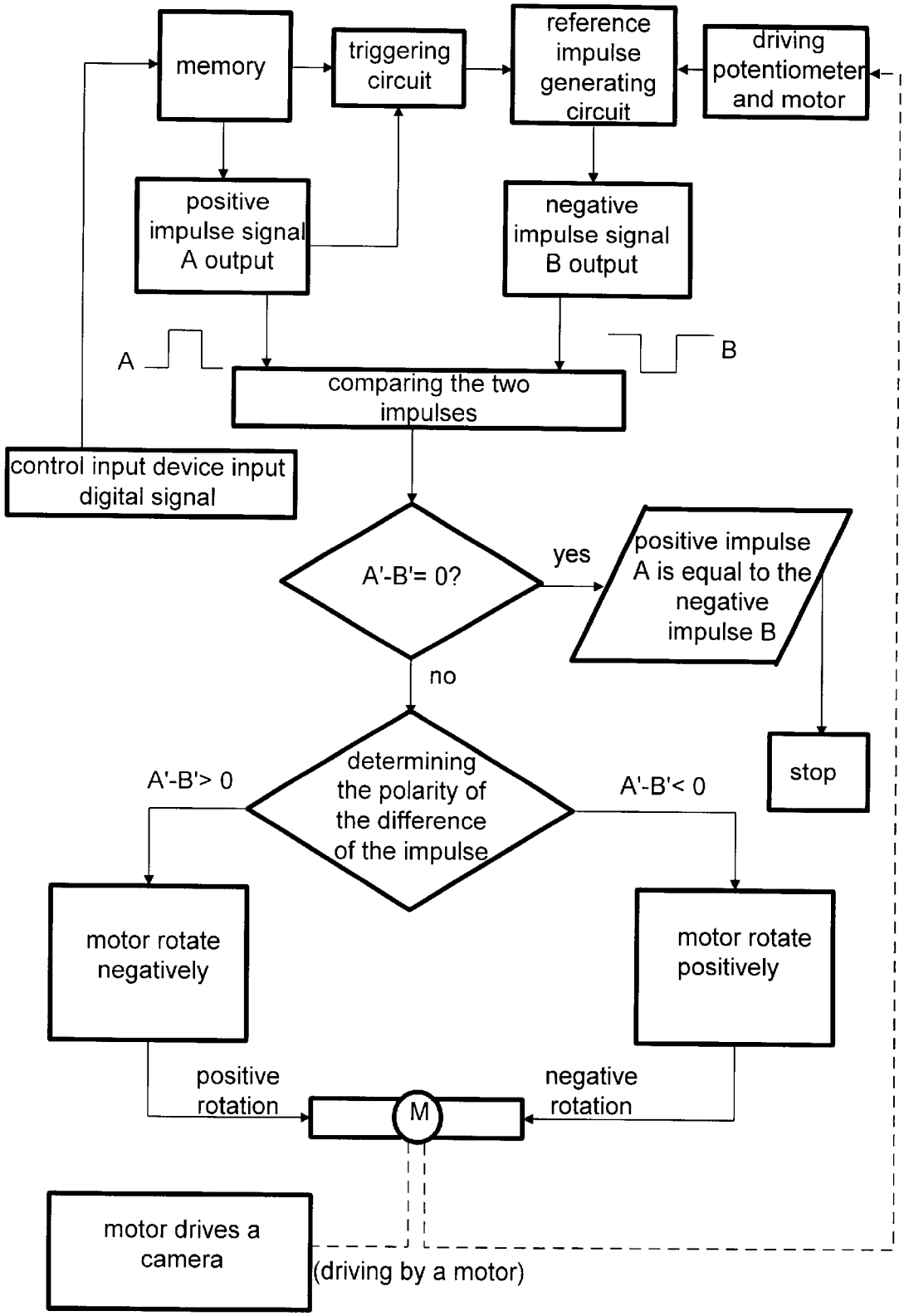
FIG. 2B shows a flow diagram of the controller of the servo in the present invention for carrying a community far end intelligent image monitor.

Referring to FIGS. 2A and 2B, the working principle about the servo control device for carrying a camera is illustrated. With reference to FIG. 2B of a flow diagram of the working principle, the symbol A in FIG. 2A represents a positive impulse signal with a determined pulse width from the microprocessor of a control circuit, the impulse signal is A' (in the following, it is briefly called as A'). Symbol B is a negative reference impulse signal generated by a reference impulse signal generating circuit of a driving operating circuit 1124. The impulse signals of the symbols A and B are opposed for being compared and adjusted conveniently. The comparison and adjudge of the symbols A and B are listed in the following.

1. If $A'-B'<0$, i.e. A' is smaller than B, then it is determined that the result of the differential impulse signal is in the same direction of B', that is, the differential impulse signal is negative. This negative differential impulse signal is extended in the driving operating circuit 1124 and then is amplified by an amplifying circuit to drive the D. C. motor 1121 to rotate inversely.

2. If $A'-B'>0$, i.e. A' is larger than B, then it is determined that the result of the differential impulse signal is in the same direction of A', that is, the differential impulse signal is positive. This positive differential impulse signal is extended in the driving operating circuit 1124 and then is amplified by an amplifying circuit to drive the D. C. motor 1121 to rotate positively.

3. If $A'-B'=0$, i.e. A' is equal to B, then it is determined that no differential impulse signal is formed. The driving operating circuit 1124 does not work and the D. C. motor 1121 stops.

Figure 3:
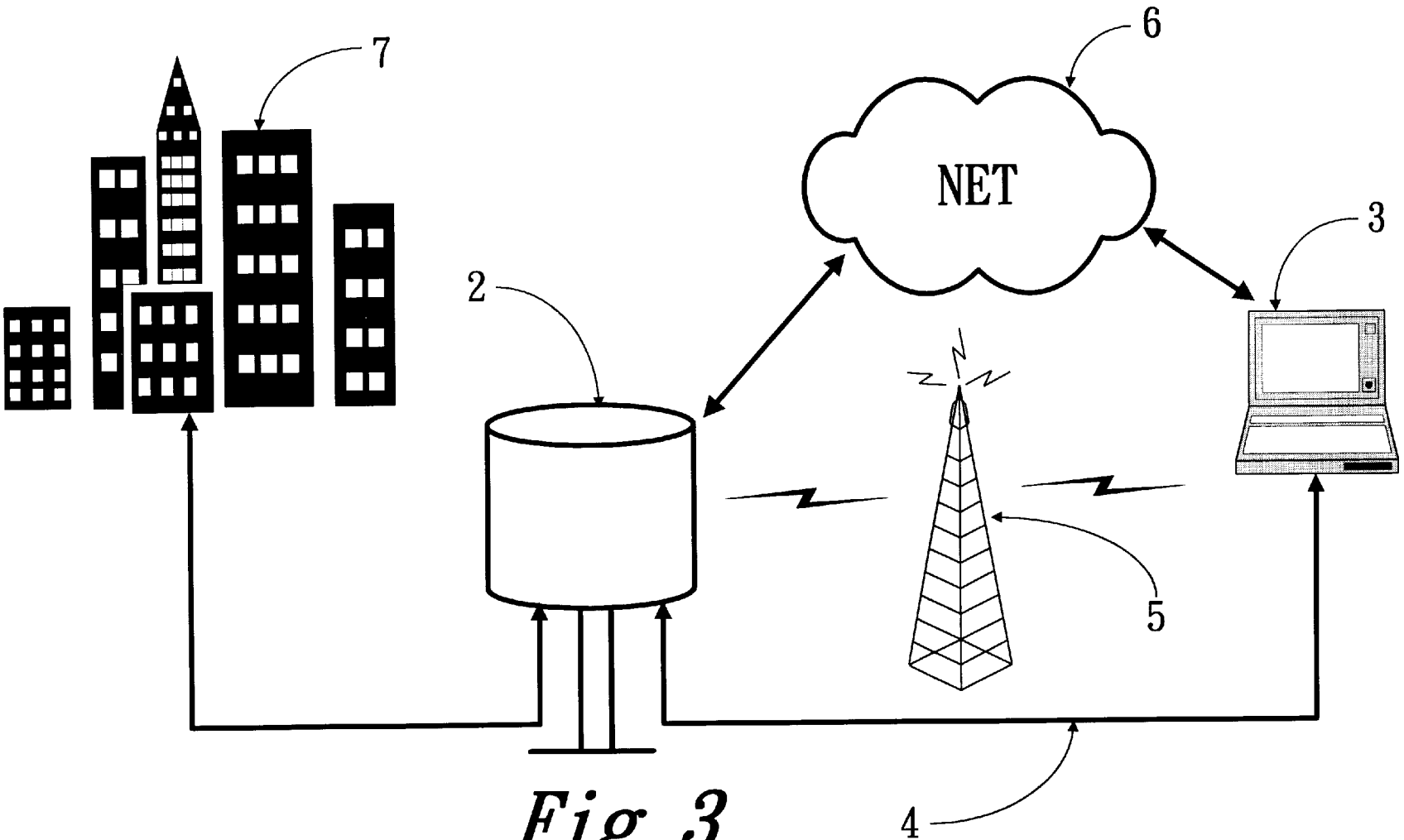
FIG. 3 shows an embodiment of the community far end intelligent image monitor in the present invention.

Referring to FIG. 3, the resident 7 installs the community far end intelligent image monitoring device of the present invention outdoors and the community far end intelligent image monitoring device is connected to the safety patrol box 2 through a transmission line. A receiving camera actuates a control signal 23 and transfers the output from the camera. Therefore, when the residents go out or an alarm emits, the portable image monitor 3 of neighbors, community managers, or safeguard members or polices will monitor. The portable image monitor 3 may transfer data by wired 4 or wireless 5 way or through Internet 6 for achieving the object of monitoring.

The community far end intelligent image monitoring device of the present invention has the following advantages superior than the prior art:

1. The present invention has the functions of positioning, memory, and automatically tracking for quick positioning and capturing images.

2. Indoor image monitoring can be performed through the outdoor safety patrol box.

3. When the residents go out or an alarm emits, the portable image monitor of neighbors, community managers, or safeguard members or polices will monitor. The portable image monitor may transfer data by wired way, or Internet, or authorized code, or wireless way or achieving the object of monitoring. Therefore, they can adapt a necessary operation.

The present invention are thus described, it will be obvious that the same may be varied in many way. Such variations are not to be regarded as a departure from the spirit and scope of the present invention, and all such modification as would be obvious to one skilled in the art to intended to be included within the scope of the following claims.

What is claimed is:

1. A secure image monitoring system for remotely monitoring a predetermined local site comprising:

an image recording unit disposed at the local site, said image recording unit including at least one camera for capturing a plurality of images of at least a portion of the local site and a programmable servo controller coupled thereto, said servo controller being actuable to control said camera in position and orientation in accordance with at least one of a plurality of predetermined modes, said predetermined modes including preset memory positioning, free positioning, and automatic track modes;

at least one portable image monitor unit disposed at a first site remote from the local site, said portable image monitor unit including a user interface portion, said portable image monitor unit being operable to generate responsive to user input a plurality of system control signals including an authorization signal and a camera control signal; and, a programmable safety patrol box unit remotely disposed at a second site remote from both the local and first sites for automatically controlling actuation of said image recording unit, said safety patrol box unit being operably coupled to each said image recording unit and said portable image monitor unit for bidirectional communication respectively therewith, said safety patrol box unit receiving and storing for selective remote transmission said images captured by said image recording unit, said safety patrol box unit including an admittance circuit portion for receiving and processing said system control signals generated by said portable image monitor unit, said safety patrol box unit being operable responsive to said processing to selectively transmit said captured images to said portable image monitor unit and actuate said servo controller operation of said image recording unit in at least one of said predetermined modes.

2. The secure image monitoring system as recited in claim 1 wherein said user interface portion of said portable image monitor unit includes an image display and at least one data entry device.

3. The secure image monitoring system as recited in claim 1 wherein said servo controller of said image recording unit including:

(a) a control box containing a programmable microprocessor based control circuit;

(b) a power switch coupled to said control box;

(c) an operational status indicator coupled to said control box;

(d) at least one interrupted input port for receiving an interrupt signal; and, (e) at least one servo port coupled to said control circuit;

(f) a keyboard coupled to said control circuit and disposed outside said control box;

(g) a liquid crystal display device coupled to said control circuit;

(h) a servo coupled to said servo port, said servo having at least one vertical servo motor and at least one horizontal servo motor;

said camera being disposes on said servo for displacement thereby in accordance with a selected one of said predetermined modes.

4. The secure image monitoring system as recited in claim 3 wherein said servo motors are operable responsive to reversibly rotate said camera with reference to a plurality of displacement coordinates, selected ones of said displacement coordinates being stored in a memory of said control circuit.

5. The secure image monitoring system as recited in claim 3 further comprising a plurality of sensing devices, said interrupt signal being generated by at least one of said sensing devices.

6. The secure image monitoring system as recited in claim 3 wherein said servo motors are configurable in accordance with an input signal generated by user input through said keyboard, said predetermined modes of image recording unit operation being parametrically adjustable thereby.

7. The secure image monitoring system as recited in claim 1 wherein said preset memory positioning mode of said image recording unit operation includes pre-storing in memory a plurality of preset coordinate points and displacing said camera sequentially in accordance therewith.

8. The secure image monitoring system as recited in claim 1 wherein said servo controller of said image recording unit includes at least one DC servo motor, and a potentiometer, a deceleration gear, and a driving circuit coupled thereto.

9. The secure image monitoring system as recited in claim 1 wherein said camera of said image recording unit is concurrently displaceable along horizontal and vertical directional references.

10. The secure image monitoring system as recited in claim 1 wherein said automatic track mode of said image recording unit operation includes scanning of said camera between a plurality of preset positional coordinates in both along both a vertical and a horizontal directional reference, said camera scanning being independently variable in rate along said vertical and horizontal directional references.

11. The secure image monitoring system as recited in claim 1 wherein said safety patrol box unit is operably coupled to said image recording unit by a wireless communications link.

12. The secure image monitoring system as recited in claim 1 wherein said safety patrol box unit is operably coupled to said portable image monitor unit by a wireless communications link.

13. The secure image monitoring system as recited in claim 1 wherein said safety patrol box unit includes an image transmitter coupled to said admittance circuit, said image transmitter being operable responsive to an output signal generated by said admittance circuit to transmit at least a portion of said captured images to said portable image monitor unit.

14. The secure image monitoring system as recited in claim 1 wherein said admittance circuit of said safety patrol box unit transmits to said servo controller of said image recording unit a signal for selecting at least one said predetermined mode of operation therefor.

15. The secure image monitoring system as recited in claim 14 wherein said user interface portion of said portable image monitor unit includes a joy stick for controlling the orientation of said camera of said image recording unit.

16. The secure image monitoring system as recited in claim 1 wherein said safety patrol box unit includes at least one tamper sensing device and an alarm coupled thereto, said alarm being triggered responsive to an output signal generated by said tamper sensing device.

17. The secure image monitoring system as recited in claim 1 wherein said safety patrol box unit includes at least one indicator for generating a plurality of predetermined visual signals indicative of system operational state.

18. The secure image monitoring system as recited in claim 1 wherein said user interface portion of said portable image monitor unit includes a card reader for reading a user provided card and generating said authorization signal therefrom.

19. The secure image monitoring system as recited in claim 1 wherein said user interface portion of said portable image monitor unit includes a keyboard device for generating said authorization signal from user entered keystrokes.

20. The secure image monitoring system as recited in claim 1 wherein a plurality of said portable image monitor units are operably coupled to said safety patrol box unit for bidirectional communication therewith.

* * * * *